United States Patent [19]

Bornstein et al.

[11] 4,246,323

[45] Jan. 20, 1981

[54] PLASMA SPRAYED MCRALY COATING

[75] Inventors: Norman S. Bornstein, West Hartford; Francis J. Wallace, Windsor; Michael A. De Crescente, Wethersfield, all of Conn.

[73] Assignee: United Technologies Corporation, Hartford, Conn.

[21] Appl. No.: 74,565

[22] Filed: Sep. 11, 1979

Related U.S. Application Data

[60] Continuation-in-part of Ser. No. 963,491, Nov. 24, 1978, abandoned, which is a division of Ser. No. 815,612, Jul. 13, 1977, Pat. No. 4,152,223.

[51] Int. Cl.[3] ..... B32B 15/00

[52] U.S. Cl. ..... 428/678; 148/4; 427/34; 427/367; 427/405; 428/652; 428/667; 427/383.9

[58] Field of Search ..... 148/4; 428/652, 667–678; 427/34, 367, 377, 383 D, 405

[56] References Cited

U.S. PATENT DOCUMENTS

| | | | |
|---|---|---|---|
| 3,361,562 | 1/1968 | Ulrich et al. | 427/376 X |
| 3,542,530 | 11/1970 | Talboom et al. | 428/678 X |
| 3,594,219 | 7/1971 | Maxwell et al. | 427/405 |
| 3,676,085 | 7/1972 | Evans et al. | 428/668 |
| 3,754,903 | 8/1973 | Goward et al. | 428/667 X |
| 3,866,301 | 2/1975 | Salsgiver | 29/412 |
| 3,873,347 | 3/1975 | Walker et al. | 427/405 X |
| 3,961,098 | 6/1976 | Bessen | 427/34 |
| 3,978,251 | 8/1976 | Stetson et al. | 427/405 X |
| 4,070,507 | 1/1978 | Stueber et al. | 427/405 X |
| 4,145,481 | 3/1979 | Gupta et al. | 428/678 |

OTHER PUBLICATIONS

Arnold et al., "Process for High-Integrity Casting", Airforce Mtl's Lab., Airforce Systems Command, Wright-Patterson, IR-162-2 (II), 11/72.

Frost, L., "New Manufacturing Processes & Techniques", Memo 33, North American Rockwell Aerospace & Systems Group, 1973.

*Primary Examiner*—R. Dean
*Assistant Examiner*—W. G. Saba
*Attorney, Agent, or Firm*—Charles G. Nessler

[57] ABSTRACT

An article with an improved MCrAlY coating is disclosed wherein a plasma sprayed MCrAlY coating is provided with a metallic envelope and then hot isostatically pressed to densify the coating and interdiffuse the envelope. Thus, the substrate is provided with a coating which in its bulk is the densified plasma coating with an outer surface zone which is enriched in a metal which enhances the oxidation-corrosion protective properties of the coating. Preferred coatings have a standard CoCrAlY bulk with a metal-enriched surface zone of about 0.02 mm depth. When aluminum is added the surface zone is comprised by weight percent of about 60 Co, 20 Cr and 22 Al. With chromium the surface zone is about 50 Co, 43 Cr and 8.5 Al.

6 Claims, 4 Drawing Figures

PLASMA SPRAYED MCRALY COATING

This is a continuation in part of Ser. No. 963,491 filed Nov. 24, 1978, now abandoned, which was a divisional application of Ser. No. 815,612, now U.S. Pat. No. 4,152,223, filed July 13, 1977.

BACKGROUND OF THE INVENTION

The present invention relates to articles having high temperature coatings of the MCrAlY type.

It is well known that the family of high temperature, oxidation-corrosion resistant coatings commonly referred to as MCrAlY coatings can markedly extend the service life of gas turbine blades, vanes and like components; for example, see U.S. Pat. Nos. to Evans et al 3,676,085; Goward et al 3,754,903 and Talboom Jr. et al 3,542,530, all of which are of common assignee with the present invention. The MCrAlY coatings are referred to as overlay coatings, denoting the fact that they are deposited on the substrate as an alloy and act substantially independently of the substrate in providing oxidation-corrosion protection.

In the past, these coatings have been applied to superalloy substrates by vapor deposition, sputtering, and plasma spraying techniques.

Of the three, sputtering is of the least current interest because of its relatively low rate of deposition. Vapor deposition coatings have received the most attention because of the cleanliness of the vacuum-applied coating and the control which is possible. Vapor deposited coatings are comprised of a plurality of abutting columnar grains typically oriented normal to the surface of the superalloy substrate. However, the vapor deposited coating composition choice is limited to elements which are compatibly vaporized.

Plasma spraying appears to offer the greatest versatility in manufacturing operations: equipment cost is comparatively low, variation in thickness from point to point is readily achievable, and coating composition can be readily altered by change in powder. However, in plasma spraying MCrAlY coating alloys on superalloy substrates, less than satisfactory results have been experienced due to the development of interconnected, as well as isolated pores, voids and like defects in the coating, some of which extend to and penetrate the outer or free surface of the coating. It has been observed that such defects adversely affect the oxidation-corrosion resistance of MCrAlY coatings, for example, as compared to that of similar vapor deposited coatings.

Various improvements in MCrAlY coatings have been disclosed previously in U.S. Patents. In vapor deposited MCrAlY type coating, Walker et al U.S. Pat. No. 3,873,347, indicates that an overcoat of aluminum increases the corrosion resistance. The aluminum was applied by the conventional pack cementation process at 600°-1000° C. Some specimens were post heat treated at 1080° C. It was stated that laboratory tests showed improved corrosion resistance, although this is somewhat at variance with the conventional wisdom now that aluminum enrichment provides mostly improved oxidation rather than corrosion resistance. By weight percent, Walker's broadest MCrAlY is 14-35 Cr, 4-20 Al, 0.1-34, and the surface is aluminized to a depth of about 1-2 mils (0.025-0.05 mm).

Bessen U.S. Pat. No. 3,961,098 discloses a coating produced by plasma spraying according to a certain specialized technique, followed by subsequent infiltration into the surface of the sprayed coating to fill the voids. Unexpectedly aluminum and chromium are reported to be diffused through the coating, even to the point of obtaining some negative concentration gradients with respect to the surface, as shown in FIGS. 4-6 of the patent. Further, the MCrAlY plasma coating of Bessen is said to not be a conventional one wherein the particles are melted, but instead to be comprised of "heated rather than molten particles in order to enhance retention of deformation . . .". Subsequently, when aluminum or chromium are interdiffused, the MCrAlY recrystallizes. Aluminum of 8-20% by weight and chromium contents of 20-30% are taught in Bessen.

In our U.S. Pat. No. 4,152,223 we disclose and claim an improved method of obtaining plasma sprayed MCrAlY coatings, wherein the plasma sprayed coating, having been deposited on the substrate, is provided with a metallic envelope and is then hot isostatically pressed (HIP) to seal the defects and interdiffuse the envelope with the plasma spray coating.

SUMMARY OF THE INVENTION

An object of the invention is to provide a superalloy having a MCrAlY coating, wherein the coating is both free of pores and corrosion resistant, wherein the basic coating composition can be freely chosen, and wherein the outer or exposed surface zone of the coating has special properties compared to the bulk of the coating.

According to the invention, a coated article is comprised of a metal substrate with a MCrAlY plasma coating thereon. The bulk of the plasma coating is substantially free of pores, voids and similar defects, and has an outer surface zone which is enriched in a metal which enhances the oxidation-corrosion protectiveness of the MCrAlY coating. The article coating is formed by first plasma spraying; it is then provided with a metallic envelope and hot isostatic pressed to cause densification and interdiffusion of the envelope to form the outer zone.

In a preferred embodiment of the invention, a 0.02 mm chromium electroplate is applied over a 0.18 mm MCrAlY plasma coating which has been conventionally applied to a substrate. Then the coated and plated article is hot isostatically pressed to close the porosity in the coating and cause interdiffusion in the surface of the coating, resulting in a coating with a chromium rich outer surface zone which is particularly suited for applications wherein the article is subjected to hot corrosion. In another embodiment, aluminum is applied to the plasma coating surface as a foil and the article is hot isostatically pressed to produce an outer surface which is particularly suited to resisting oxidation.

Compared to prior art coatings, the present invention provides a coating which has a plasma sprayed metallurgical structure enriched in a particular metal only in a relatively small portion of its thickness near the surface. For example, a 0.18 mm thick MCrAlY coating would be enriched by aluminum or chromium to a depth of about 0.02 mm. While hot pressing of articles using metallic envelopes is known in the prior art, the present invention results from the use of a metallic envelope which both provides the impermeable layer necessary to hot press and densify the porous plasma coating and which specially alters the properties of the surface of the MCrAlY coating.

Improved MCrAlY coatings of the prior art were mentioned in the Background section. Consideration of those will show that they are variously dissimilar vapor deposited structures, relatively uniformly infiltrated or enriched structures, or produced by a process wherein an intermetallic aluminide layer is formed within the first-applied MCrAlY layer by pack cementation. Thus the present invention involves both the product of a novel process and a coated article which is metallurgically distinct from those of the prior art.

DESCRIPTION OF THE PREFERRED EMBODIMENT

Although the exemplary embodiment of the invention set forth herein relates to a plasma sprayed CoCrAlY overlay coating on a nickel or cobalt base superalloy substrate, it is offered only for illustration and is not intended to limit the scope of the present invention. The invention has general applicability within the family of high temperature coatings designated MCrAlY overlay coatings, wherein M is selected from nickel, cobalt and iron and combinations thereof, and to any suitable metal or alloy, but most especially, high strength superalloys having cobalt or iron bases.

The method of obtaining the coating of our present invention is fully described in our U.S. Pat. No. 4,152,223, although we may add herein some details which reflect improvements discovered during a development program which still continues.

In the preferred practice of the invention, a CoCrAlY overlay coating of composition, by weight, 65.5% Co, 22.0% Cr, 12.0% Al and 0.5% Y is plasma sprayed onto a substrate of the nickel base superalloy B-1900 (by weight, 8.0% Cr, 10.0% Co, 1.0% Ti, 6.0% Al, 6.0% Mo, 4.3% Ta, balance nickel) any conventional or improved plasma spray process is usable, provided the composition of the deposited coating is controlled to the foregoing nominal composition, and the particles are melted before deposition. The best density coating attainable is desired. The coating is deposited to a thickness of about 0.18 mm. As applied, the plasma coating will be comprised of melted and solidified (cast) particles of a generally equiaxed shape. Occasionally, they may have a flattened appearance when viewed in a plane normal to the substrate surface. Inherent in practically all current processes, the coating will have some pores. Next a layer of chromium or aluminum is applied over the coating. Electroplating is preferred for chromium while aluminum is preferably applied as a foil. It will be found that the surface voids and pores of the plasma coating are spanned by the electroplate or the foil, when they are applied in a thickness of about 0.02 mm. Thus, the plasma coating is thereby sealed to external pressure. Next the article is subjected to hot isostatic pressing using parameters sufficient to densify the coating and interdiffuse the metallic envelope. For example, a chromium layer of about 0.02 mm on a 0.18 mm MCrAlY coating would be pressed for four hours at 1070° C. and 100 MPa.

Figure 1A:
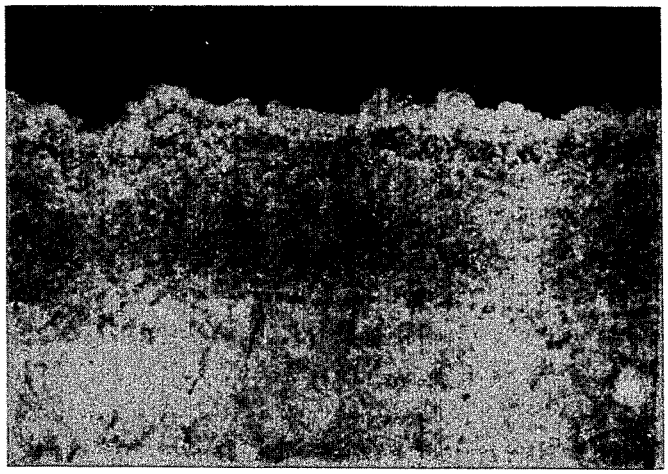
FIG. 1 illustrates the structure of a plasma spray coating of the present invention after HIP, at 1 (a) by a photograph and at 1 (b) by a drawing.
Figure 1B:
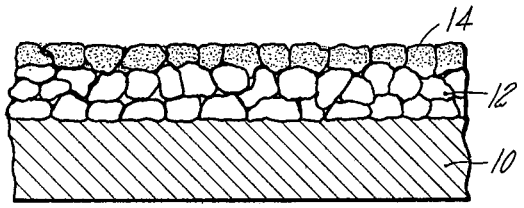

The resultant coated substrate is illustrated by FIG. 1. Part (a) of the Figure is a photomicrograph of a section of a plane normal to the substrate surface, while part (b) of the Figure is a line drawing which more clearly delineates certain aspects of the photomicrograph. The substrate 10 is surmounted by the aforementioned cast equiaxed grain structure 12 having an outer surface layer 14 enriched in the metal of the envelope. This article is contrasted with an article produced according to the invention of Walker et al U.S. Pat. No. 3,873,347, wherein aluminizing is applied to a columnar grain vapor deposited MCrAlY coating; or that produced according to the invention of Bessen U.S. Pat. No. 3,961,098 wherein cementation is used to deeply infiltrate a purposely porous plasma coating.

Figure 2:
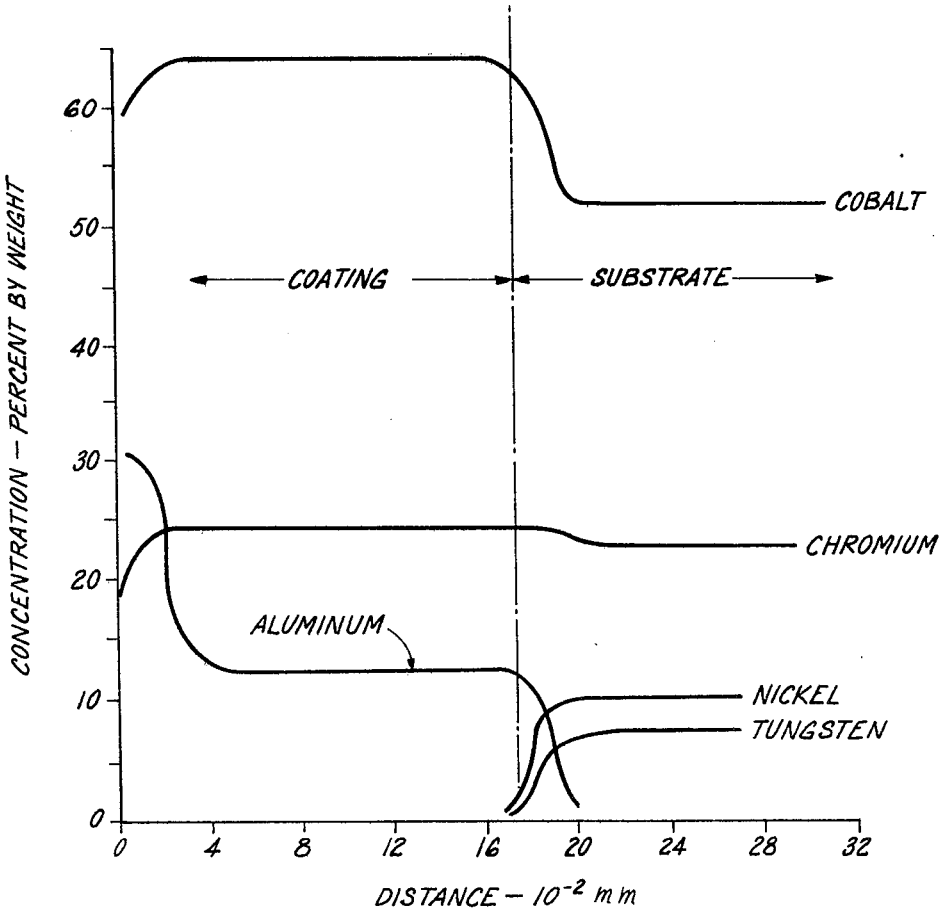
FIG. 2 is a plot of the elemental concentrations through a section of coated substrate wherein the inventive coating has an aluminum rich surface.
Figure 3:
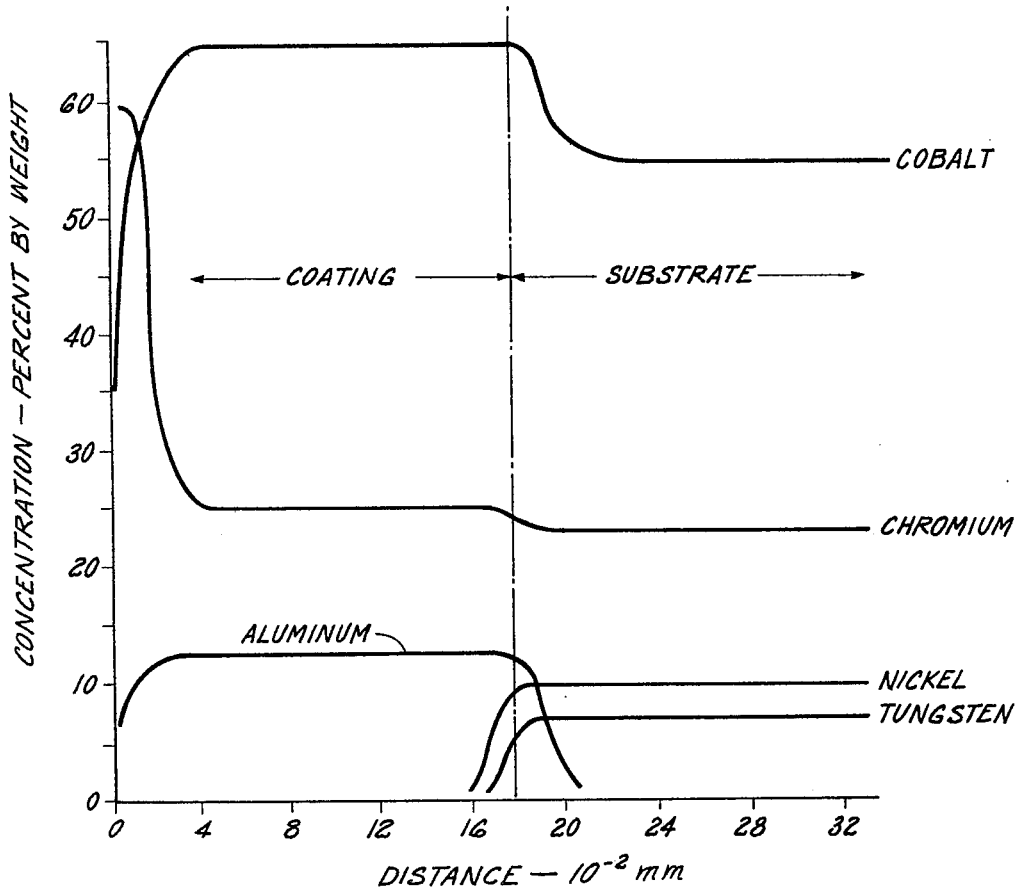
FIG. 3 is a plot similar to that of FIG. 2, for a coating with a chromium rich surface.

FIGS. 2 and 3 indicate the nominal elemental concentrations at various points along a line normal to the surface of an inventively coated substrate of MARM-509 alloy (by weight %, 23 Cr, 10 Ni, 7 W, 3.5 Ta, 0.5 Zr, 0.6 C, 0.2 Ti, bal Co). In FIG. 2, the coating resulting from an aluminum envelope on a CoCrAlY (by weight % 65.5 Co, 22Cr, 12 Al, 0.5 Y) plasma coating is seen to be substantially rich in aluminum in about the first 0.02 mm of coating; and also low in cobalt and chromium. In FIG. 3, the coating resulting from a chromium envelope on the same CoCrAlY plasma coating is seen to be an outer surface zone which is high in chromium for about the first 0.015–0.02 mm. In both instances, the bulk of the coating is seen to be essentially maintained in accord with its original composition. The table below summarizes the nominal average compositions for the various portions of the aforementioned coatings, as extracted from the Figures:

| | Element Weight Percent | | |
|---|---|---|---|
| | Co | Cr | Al |
| Bulk layer of CoCrAlY | 65 | 24.5 | 12.5 |
| Al rich surface of CoCrAlY | 60 | 20 | 22 |
| Cr rich surface of CoCrAlY | 50 | 43 | 8.5 |

To further describe our inventive coating and its use, we take the example of MCrAlY with an aluminum envelope. In a CoCrAlY coating, of the composition we indicate above, there are present intermetallic compounds such as CoAl and CrAl (and NiAl, FeAl, etc., when the other suitable elements are present in the coating). These compounds which are inherently brittle and crack prone, are present together with a matrix composed predominately of the base metal; in CoCrAlY, this would be Co with Cr in solid solution. Al would also be present in the matrix. However, the solubility of Al in the matrix is characteristically only about 5 weight percent.

In an MCrAlY coating exposed to oxygen, alumina, which is formed preferentially to chromia, provides a protective surface. With the passage of time, due to various mechanisms such as erosion or spalling, alumina will be lost from the coating surface. Thus, it is desirable to have a reservoir of aluminum within the coating, and the intermetallic phase provides this. However, the amount of intermetallic phase within the bulk of the coating must be limited because high amounts make the total coating unacceptably brittle and prone to thermal fatigue. Thus the advantage of our invention when using aluminum as the envelope can be seen: the surface is enriched in aluminum, but the bulk of the coating is not. So, while the surface may tend to be somewhat brittle, it is also very resistant to oxidation. And yet the bulk of the coating has uniformity and good mechanical properties attributable to the optimal composition range for bulk MCrAlY coatings. And of course the entire coating is dense by virtue of the HIP operation.

Now considering the case of a chromium envelope, it is known that chromia is more resistant than alumina to corrodents such as $Na_2SO_4$ and $V_2O_5$. Corrodents may initially attack and consume alumina in an MCrAlY coating, but be then inhibited further by the presence of chromia. Thus, when a chromium enriched outer surface is obtained in our inventive coating, the volume fraction of the solid solution phase will be increased, and the intermetallic phase accordingly reduced. Since the solid solution phase contains chromium, the capability of the surface to resist hot corrosion is enhanced. But the capability of the entire system to resist oxidation is still sustained because of the reservoir of aluminum in the bulk of the coating beneath the chromium enriched surface layer. It may also be noted that although the chromium gradient appears high, as in FIG. 3, the activity, or thermodynamic force driving chromium into the rest of the bulk of the coating, is not great since all phases are in equilibrium within the bulk of the coating.

Previously, non-porous coatings were only conveniently applied by vapor deposition. Accordingly, only compositions which were vaporizable at somewhat compatible rates could be codeposited, and the composition of the bulk layer MCrAlY was accordingly limited. In other instances, although bulk coatings of more varied compositions might be applied, as by plasma coating, they were either characterized by porosity, or by the formation of a brittle intermetallic (aluminide) within the MCrAlY. Now it is possible to obtain a dense MCrAlY bulk by virtue of the plasma spraying and hot pressing, together with a surface layer of a composition of choice, and desirably limited depth. And the plasma sprayed bulk may contain elements not readily vaporizable, to attain other ends.

As may be evident, the thickness of the metallic envelope and the HIP parameters can be varied to achieve different objects of the invention. It is possible thus to obtain somewhat thinner and thicker surface layers in the completed coating. Also, metals other than aluminum and chromium may be used as the metallic envelope to achieve other objects of the invention.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. An article with improved oxidation-corrosion resistance, usable in a gas turbine engine, comprising a superalloy component having an oxidation-corrosion protective MCrAlY type coating adhered thereto, where M is selected from the group consisting of nickel, cobalt and iron and where the coating is produced by the process which includes:

(a) plasma spraying the MCrAlY coating onto the superalloy substrate, the coating being characterized as having pores, voids and similar defects, some of which extend to the free surface of the coating, said defects reducing the protectiveness of the coating;

(b) sealing the free surface of the MCrAlY coating by providing a metallic envelope thereover, said envelope spanning and sealing the defects which extend to the free surface of the coating; and (c) hot isostatically pressing the coated substrate at a sufficient pressure and temperature and for a sufficient time to close the defects internal of the MCrAlY coating and those intersecting said free surface and to diffuse at least a portion of the metallic envelope into the MCrAlY coating, closure of said defects and diffusion of said metal envelope into the coating significantly enhancing the oxidation-corrosion protective properties of the coating.

2. The article of claim 1 wherein the outer zone is enriched in aluminum.

3. The article of claim 1 wherein the outer zone is enriched in chromium.

4. The article of claim 1 wherein the envelope of metal is a chromium electrodeposit.

5. The article of claim 1 wherein the weight percent composition of the bulk of the coating is comprised of about 65 Co, 24 Cr, 12 Al and that of the outer zone is about 60 Co, 20 Cr, 22 Al.

6. The article of claim 1 wherein the weight percent composition of the bulk of the coating is comprised of about 65 Co, 24 Cr, 12 Al, and that of the outer zone is about 50 Co, 43 Cr, 8.5 Al.

* * * * *